US005575686A

United States Patent [19]

Noschese

[11] Patent Number: 5,575,686

[45] Date of Patent: Nov. 19, 1996

[54] STACKED PRINTED CIRCUIT BOARDS CONNECTED IN SERIES

[75] Inventor: Rocco J. Noschese, Wilton, Conn.

[73] Assignee: Burndy Corporation, Norwalk, Conn.

[21] Appl. No.: 46,625

[22] Filed: Apr. 14, 1993

[51] Int. Cl.[6] ..... H01R 9/09

[52] U.S. Cl. ..... 439/620; 327/262; 361/785; 439/74

[58] Field of Search ..... 439/74, 75, 620; 361/683, 685, 764, 773, 785–792; 327/565, 141, 262; 326/101

[56] References Cited

U.S. PATENT DOCUMENTS

| | | | |
|---|---|---|---|
| 2,854,552 | 9/1958 | Gouverneur II | 200/158 |
| 3,836,935 | 9/1974 | Johnson | 339/17 LM |
| 3,977,075 | 8/1976 | Lynch et al. | 29/628 |
| 4,142,226 | 2/1979 | Mears | 439/59 |
| 4,222,626 | 9/1980 | Hollyday et al. | 439/525 |
| 4,352,533 | 10/1982 | Murase et al. | 339/17 L |
| 4,373,309 | 2/1983 | Lutz | 52/182 |
| 4,473,263 | 9/1984 | Sunstein | 339/17 LM |
| 4,514,784 | 4/1985 | Williams et al. | 439/59 |
| 4,645,943 | 2/1987 | Smith, Jr. et al. | 439/69 |
| 4,653,838 | 3/1987 | Ney et al. | 439/620 |
| 4,686,506 | 8/1987 | Farago | 439/620 |
| 4,756,694 | 7/1988 | Billman et al. | 439/61 |
| 4,857,002 | 8/1989 | Jensen et al. | 439/620 |
| 4,862,400 | 8/1989 | Selbrede | 364/708 |
| 4,871,316 | 10/1989 | Herrell et al. | 439/68 |
| 4,929,185 | 5/1990 | Wong et al. | 439/74 |
| 4,950,170 | 8/1990 | Miller, Jr. | 439/74 |
| 5,013,249 | 5/1991 | Lindeman et al. | 439/66 |
| 5,051,606 | 9/1991 | Ikehara | 307/134 |
| 5,059,130 | 10/1991 | Miller, Jr. | 439/74 |
| 5,176,526 | 1/1993 | Hillbish et al. | 439/108 |
| 5,181,855 | 1/1993 | Mosquera et al. | 439/74 |
| 5,296,748 | 3/1994 | Wicklund | 327/565 |

OTHER PUBLICATIONS

"Dallas Semiconductor 1992–1993 Product Data Book", pp. 5–1:5–6, and pp. 5–32:5–42.

*Primary Examiner*—Neil Abrams
*Attorney, Agent, or Firm*—Perman & Green

[57] ABSTRACT

A system for connecting printed circuit boards to each other includes electrical connectors and positioners. The positioners fixedly position the boards relative to each other in a general spaced parallel configuration. The electrical connectors can connect the boards to each other in series. The connectors include power contacts, ground contacts, and driver circuits located inside the connector housing. The driver circuit has a transceiver for synchronous two way communications and buffers for repeating and strengthening digital signals.

21 Claims, 6 Drawing Sheets

24
34
31
29
27
26
36
10 B

STACKED PRINTED CIRCUIT BOARDS CONNECTED IN SERIES

BACKGROUND OF THE INVENTION

1. Field of the Invention

The present invention relates to electrical connector systems and, more particularly, to a system for connecting printed circuit boards to each other in series.

2. Prior Art

U.S. Pat. Nos. 4,473,263; 4,756,694; and 4,862,400 disclose circuit board mounting devices for individually connecting printed circuit boards to a mother printed circuit board in parallel. However, there has developed a need for stacking printed circuit boards and connecting them in series to a mother board. A problem with stacking printed circuit boards and connecting them in series exists in that signals will be interfered with due to relatively large capacitance in transmitting signals through multiple connectors and long signal transmission paths, such as to the top board on a stack of multiple printed circuit boards connected in series. Another problem encountered in stacking printed circuit boards and connecting them in series is clock distribution or skew due to unequal lengths of global clock lines to each printed circuit board. It is an object of the present invention to overcome problems in the prior art by providing a new system for connecting printed circuit boards to a mother board in series.

SUMMARY OF THE INVENTION

In accordance with one embodiment of the present invention a system for connecting printed circuit boards to each other is provided comprising a first electrical connector and positioners. The first electrical connector directly connects two of the printed circuit boards to each other and has a housing with a driver circuit located therein. The driver circuit includes a transceiver for synchronous two way communication between the two boards. The positioners are located, at least partially, between the two printed circuit boards and fixedly position the two boards relative to each other in a spaced parallel configuration.

In accordance with another embodiment of the present invention a printed circuit board assembly is provided comprising a plurality of spaced parallel printed circuit boards, a plurality of electrical connectors, and positioners. The electrical connectors connect at least some of the printed circuit boards to each other in series. The electrical connectors are sandwiched between adjacent boards and aligned in at least one row. At least one of the electrical connectors has a driver circuit with a buffer adapted to repeat and strengthen digital signals transmitted therethrough. The positioners are fixed to the printed circuit boards to hold the boards in their spaced parallel configuration.

In accordance with another embodiment of the present invention an electrical connector is provided comprising a housing and at least one driver circuit located in the housing. The housing has a bottom member and a top member connected to each other that form a driver circuit receiving area located inside the housing. The driver circuit is located in the receiving area and has a printed circuit board section and contact sections for connecting the printed circuit board section to contact areas on opposing printed circuit boards when the electrical connector is connected to the opposing printed circuit boards.

In accordance with another embodiment of the present invention an electrical connection system for connecting first and second printed circuit boards to each other is provided. The system comprises a contact header, an electrical connector, and a cover. The contact header is fixedly connected to the first printed circuit board and comprises a frame and a plurality of first electrical contacts having first male contact areas extending from the first board. The electrical connector comprises a housing and a plurality of second electrical contacts. The second electrical contacts includes power contacts, ground contacts, and signal contacts with first ends having female contacts areas removably connected to the male contact areas of the first electrical contact and second ends connected to the second printed circuit board adjacent a first side of the second board. The cover is removably connected to the second printed circuit board and to the electrical connector. The cover is located on a second side of the second printed circuit board and covers second male contact areas extending from the second side of the second printed circuit board.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
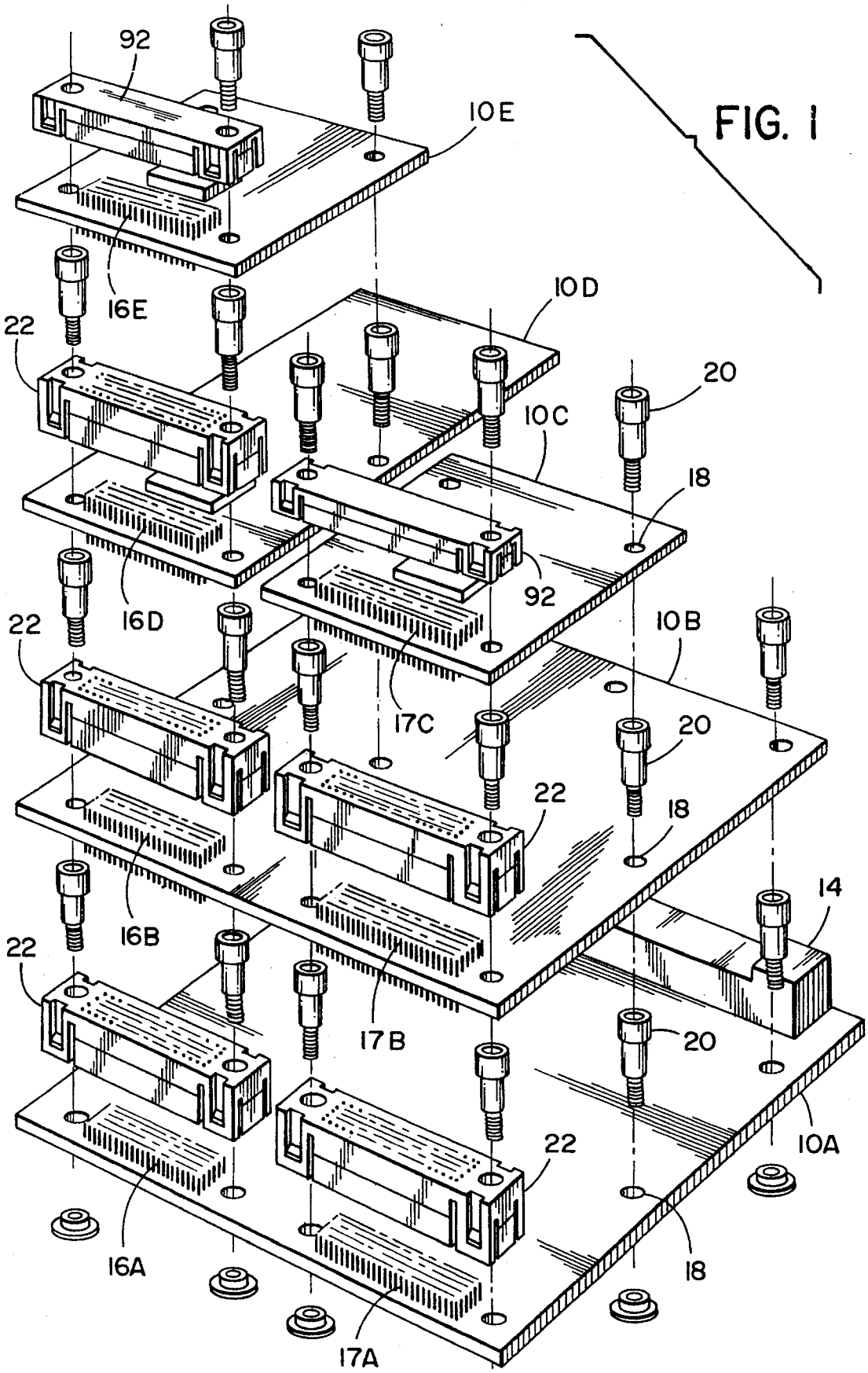
FIG. 1 is an exploded perspective view of an assembly of printed circuit boards connected in series by a connecting system incorporating features of the present invention.

Referring to FIG. 1, there is shown an exploded perspective view of an assembly 12 of a plurality of printed circuit boards 10A–10E connected to each other by means of a system incorporating features of the present invention. Although the present invention will be described with reference to the embodiments shown in the drawings, it should be understood that the present invention could be embodied in various different forms of embodiments. In addition, any suitable size, shape or type of members or materials could be used.

The boards 10A–10E are connected as an assembly 12 that is used in a device, such as a computer (not shown). The assembly 12 includes a base board or mother board 10A and a plurality of input/output/auxiliary boards 10B–10E. The base board 10A has a connector 14 for connecting the base board to input/output devices such as a printer, a mouse, a plotter, a monitor, etc. In the embodiment shown, mounted at the opposite end of the base board 10A are male contact pins in two groups 16A, 17A. Of course, any suitable member of groups could be provided at any suitable location on the base board 10A. Other types of contacts could also be provided. The base board 10A also has holes 18 for positioners 20 as further understood below. The other boards 10B–10E also have holes 18 for positioners 18 and groups of male contact pins 16B, 16D, 16E, 17B, 17C. Each of the pins of the groups 16, 17 is not necessarily electrically connected to circuitry in its associated board, but rather, may function merely as a means for transmission of signals, power, or ground past its board to another board.

Figure 2:
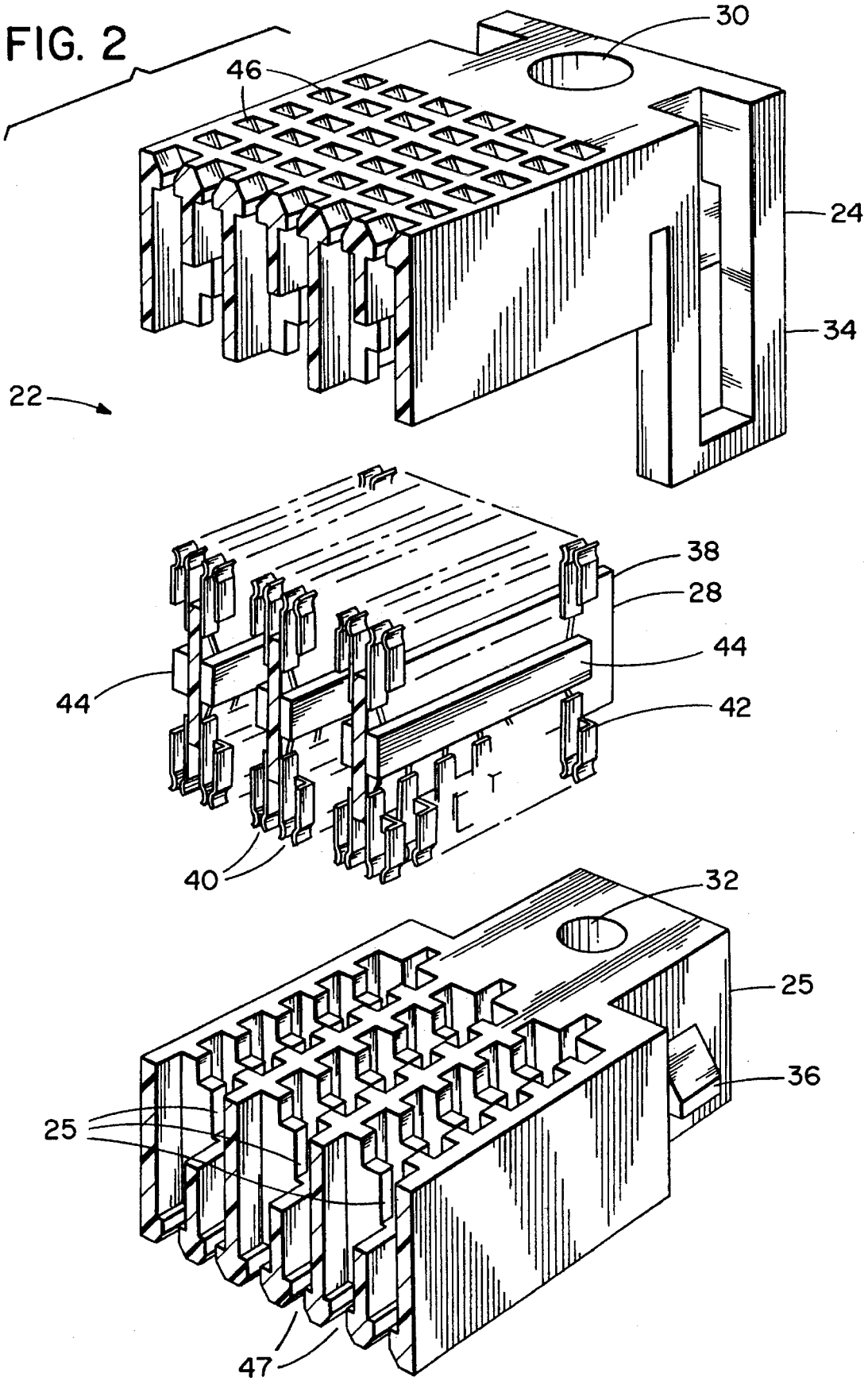
FIG. 2 is an exploded cut-away view of an end of one of the electrical connectors used in the system shown in FIG. 1.
Figure 2A:
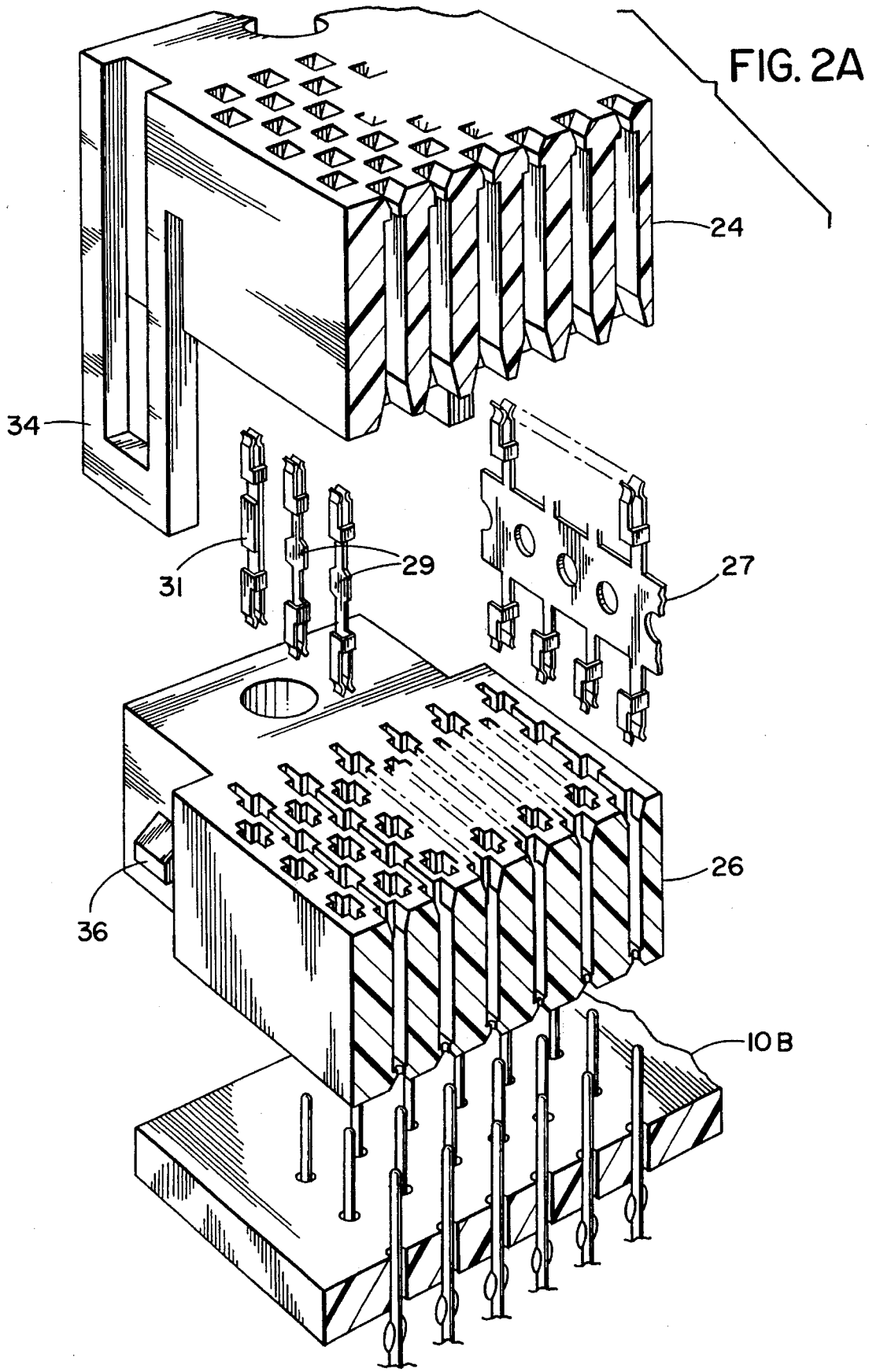
FIG. 2A is an exploded cut-away view of an opposite end of the connector shown in FIG. 2.

Connecting the boards 10A–10E to each other are electrical connectors 22. Referring also to FIGS. 2 and 2A, the electrical connectors generally comprise a housing made of dielectric material with a top housing member 24, a bottom housing member 26, driver circuits 28, ground contacts 27, power contacts 29, and signal contacts 31. The housing members 4, 26 are connected to each other with the driver circuits 28 located in receiving areas 25 between the housing members 24, 26. The ends of the housing members 24, 26 have holes 30, 32 for locating portions of positioners 20 therein. The top housing member 24 has latches 34 that snap lock latch over latches 36 on the bottom housing member 26. The driver circuits 28, ground contacts 27, power contacts 29 and signal contacts 31 are inserted into the bottom housing member 26 to enclose the circuits 28 and contacts 27, 29, 31 inside the housing members. In alternate embodiments, other types of housings could be provided. In addition, the electrical connectors 22 may not all comprise the same number of the various types of contacts/circuits 27, 28, 29, 31. The present invention, due to the large number of paths available from the multi-pin groups 16, 17, allows for modular design of the electrical connectors to operate at any level in the stacked assembly. Alternatively, the electrical connectors could be configured to merely be able to operate at a limited number of levels of the stacked assembly. The contacts 27, 29, 31 each comprise two opposite ends with female contact areas. This allows the connectors 22 to be used with boards 10 that have male contacts extending from the boards. However, any suitable type of contact area could be provided on the ends of the contacts 27, 29, 31. In the embodiment shown, the boards 10A–10E each comprise individually mounted press-fit pins that function as their male contacts.

The driver circuits 28, in the embodiment shown, each generally comprise a printed circuit board section 38 having female contacts 40 connected to conductive traces 42 on both sides and both ends of the board section 38. Each board section 38 has integrated circuit modules 44 connected to both sides of the board and electrically connected to the female contacts 40 by the traces 42. In the embodiment shown, the modules 44 comprise transceivers. The transceiver allows synchronous two-way communication between boards 10A–10E. In alternate embodiments, the modules 44 and/or the printed circuit board sections 38 could have alternative or additional circuitry features such as buffers to repeat and strengthen signals. The top and bottom housing members 24, 26 have holes 46, 47 into the receiving area 25 such that pin contacts from the groups of contacts 16, 17 can be connected to the female contacts 40 inside the connector housing.

Figure 3:
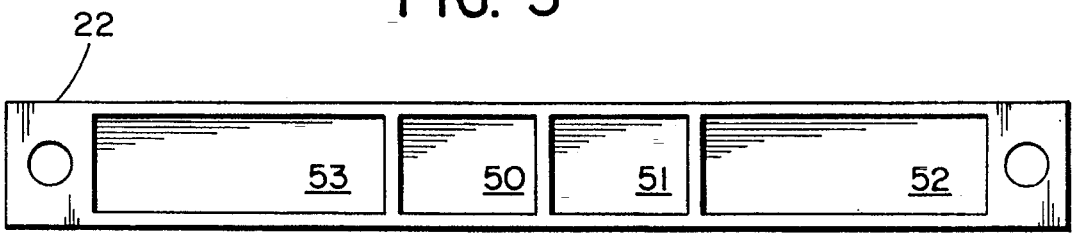
FIG. 3 is a schematic plan view of one of the electrical connectors used in the assembly shown in FIG. 1.

Referring also to FIG. 3, a schematic plan view of one of the connectors 22 is shown. In the embodiment shown, the connector has four groups 50, 51, 52, 53 of contacts/circuits. The first group 50 is comprised of power contacts 29 and ground contacts 27. The power contacts are adapted to transmit electrical power from the base board 10A to the stacked boards 10B–10E. The ground contacts 27 are adapted to connect ground contacts in the stacked boards 10B–10E to a ground in the base board 10A. The second group 51 is comprised of signal contacts 31. The signal contact 31 shown in FIG. 2A is a filtered signal contact. However, any suitable type of signal contact could be provided. The signal contacts are adapted to transmit signals from contacts on a first adjacent circuit board to contacts on an opposite second adjacent printed circuit board. The third and fourth groups 52 and 53 are comprised of the driver circuits 28. In alternate embodiments, the contacts 27, 29, 31 and driver circuits 28 could be arranged in any suitable configuration and not necessarily in groups.

Figure 4C:
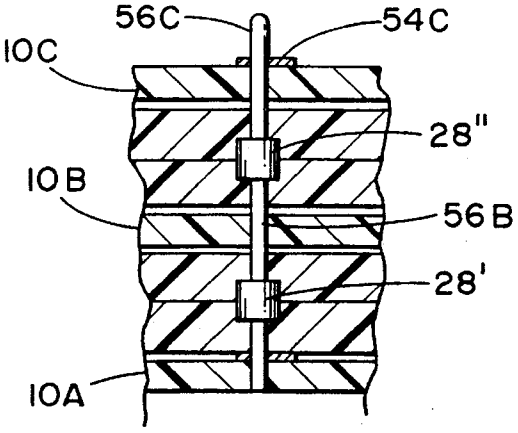
FIGS. 4A–4F are schematic enlarged sectional views of various different types of signal path interconnection between printed circuit boards.
Figure 4B:
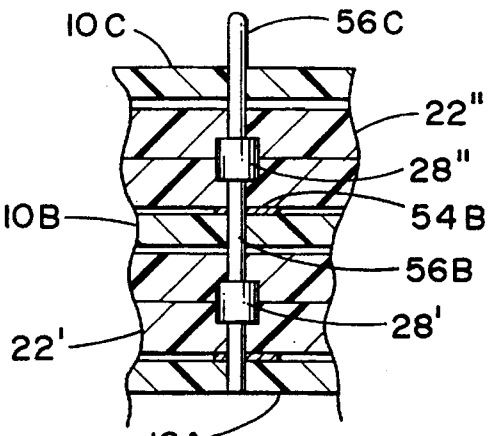
Figure 4A:
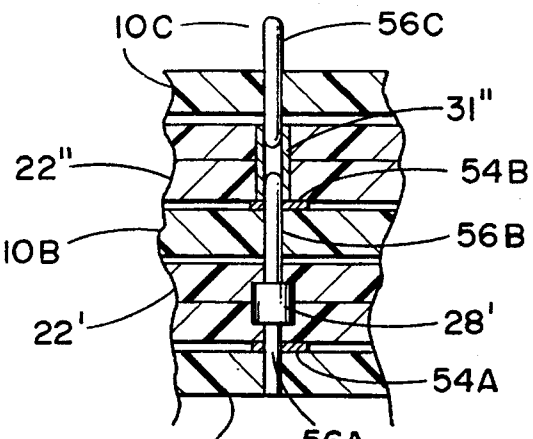

Referring also to FIGS. 4A–4F, there are schematically shown various different types of signal path interconnections among printed circuit boards 10A–10C. In FIG. 4A, a conductive trace 54A on base board 10A is connected by a male pin 56A to a first driver circuit 28' in a first connector 22'. The driver circuit 28' is connected to a male pin 56B on the second board 10B. The male pin 56B is connected to a trace 54B on the second board 10B. The male pin 56B is also connected to a male pin 56C on the third board 10C by a signal contact 31" in second connector 22". However, because male pin 56C is not connected to a trace on the third board 10C, signals are not transmitted to the third board 10C from this path.

Figure 4F:
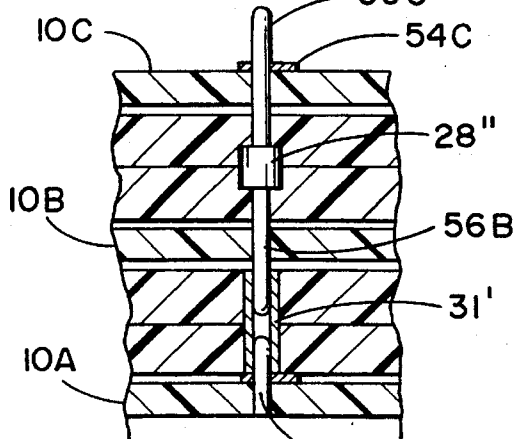
Figure 4E:
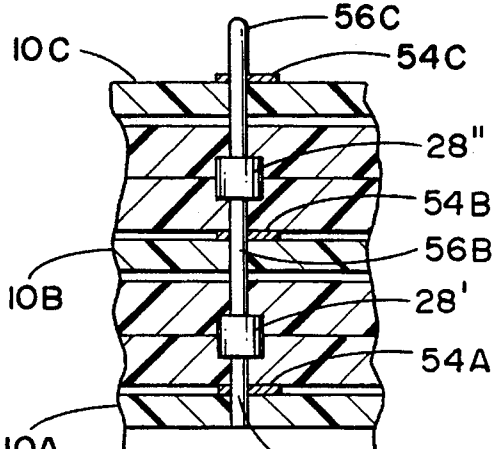
Figure 4D:
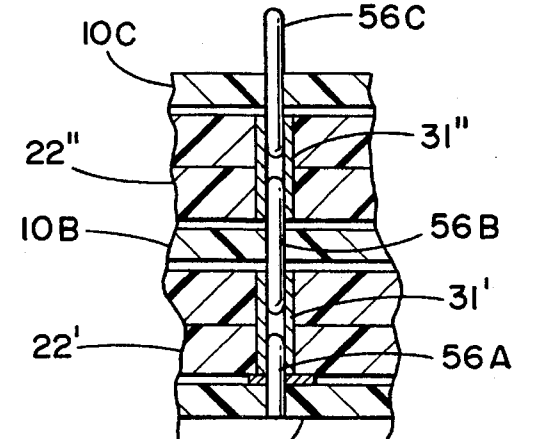

The path shown in FIG. 4B is similar to the path shown in FIG. 4A, but the second connector 22" has a second driver circuit 28" connecting the male pin 56B to the male pin 56C. The path shown in FIG. **4*c* is similar to the path shown in FIG. 4*b*. However, the male pin 56B is not connected to a trace on the second board 10B, but male pin 56C is connected to a trace 54C on the third board 10C. Therefore, signals are not transmitted to the circuitry of the second board 10B through this path, but can be transmitted between the base board 10A and the third board 10C through both the driver circuits 28', 28". FIG. 4D shows the male pins 56A, 56B, 56C connected by signal contacts 31', 31" and, neither male pin 56B nor 56C is electrically connected to circuitry in boards 10B and 10C. This type of open path could be used for connecting a fourth board on top of the third board 10C. FIG. 4E shows a signal path with all of the pins 56A, 56B, 56C electrically connected to traces on all three of the boards 10A, 10B, 10C through circuit drivers 28', 28". FIG. 4F shows a signal path where the male pin 56A is connected to the male pin 56B by means of a signal contact 31', male pin 56B is not electrically connected to circuitry on the second board 10B, male pin 56B is connected to male pin 56C through circuit driver 28", and male pin 56C is electrically connected to a trace 54C on the third board 10C. The above description of different types of paths between and through printed circuit boards is intended to be illustrative; not comprehensive. In alternate embodiments any suitable path could be provided and the connectors 22 could be uniformly or non-uniformly configured to be able to function at any level of the assembly 12; the connection of the male pins 56** to circuitry on their boards being the only physical determinator of signal path into or out of a board.

As noted above, a problem that was encountered in the past when printed circuit boards were attempted to be connected in series to a mother board was clock skew due to unequal lengths of global clock lines to each printed circuit board. The present invention is intended to overcome this clock skew problem by use of the transceivers in the electrical connectors 22. The driver circuits 28 are controlled to delay transmission of signals to and from the various levels of the assembly 12 such that signals are delivered at all of the levels at the same time. This eliminates the problem of global clock skew. The assembly 12 is generally designed to operate at very fast speed, such as at a frequency of 250 mHz. Therefore, the intrinsic delay that would otherwise exist in the stacked serially connected electronic circuitry of the assembly 12 can be substantially reduced by the circuit drivers 28. Preferably, the modules 44 are controlled by the base board 10A. However, in alternate embodiments, another one of the boards or a plurality of boards could control the modules 44. By placing the transceivers inside the electrical connectors rather than on the boards 10B–10E, this also allows the boards 10B–10E to be manufactured in smaller sizes.

Figure 8:
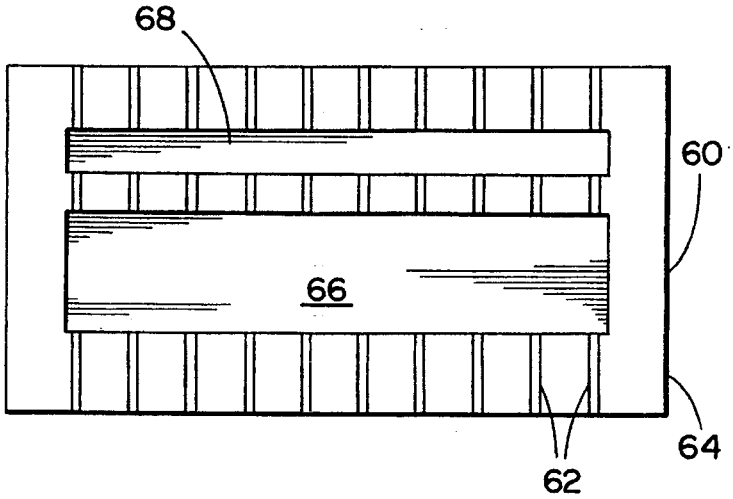
FIG. 8 is a schematic view of an alternate embodiment of a driver circuit used in an electrical connector in a system according to the present invention.

Referring also to FIG. 8, there is shown a schematic front view of an alternate driver circuit 60. The driver circuit has traces 62 on a printed circuit board section 64, a transceiver module 66, and a buffer module 68. The buffer module 68 is adapted to repeat and strengthen digital signals to make sure that the signals are properly delivered between the base board 10A and the upper stacked boards. In an alternate embodiment, the buffer module could be integrally formed with the transceiver module.

Figure 5A:
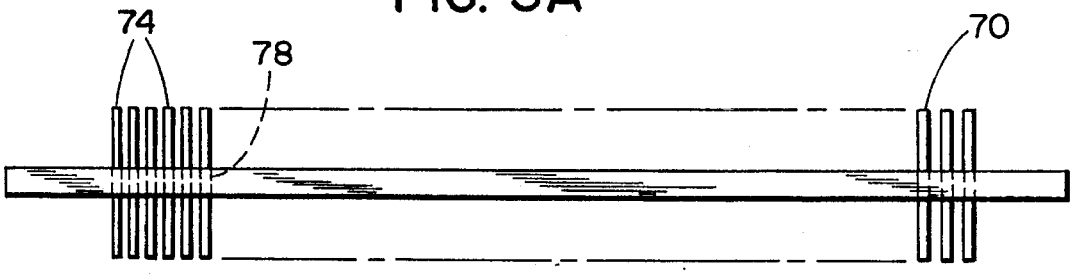
FIG. 5A is a side view of a contact pin header used in the assembly shown in FIG. 1.
Figure 5B:
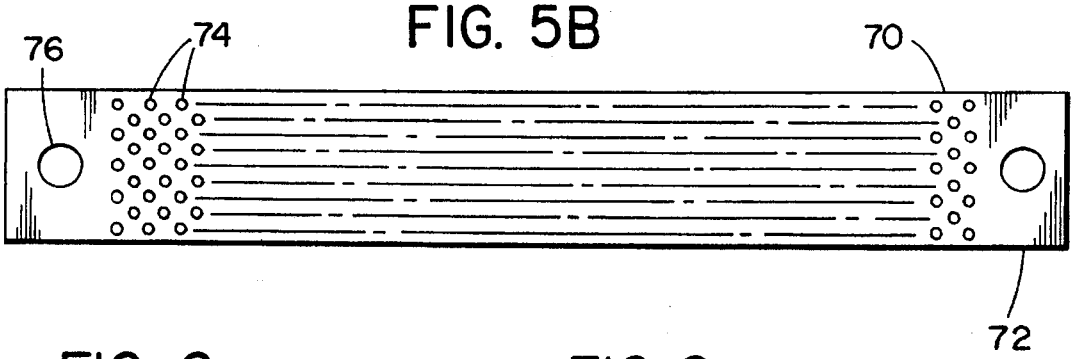
FIG. 5B is a top plan view of the contact pin header shown in FIG. 5*a*.

Referring to FIGS. 5A and 5B, there is shown a male contact pin header 70. The header 70 generally comprises a frame 72 and a plurality of male contact pins 74. The frame 72 is preferably made of dielectric material, such as molded plastic. The frame 72 has positioner holes 76 for positioners 20 to pass through and pin holes 78 that the pins 74 are fixedly mounted in. The pins 74 in the embodiment shown are arranged in fourteen offset rows of twenty-five pins each for a total of three hundred and fifty pins with a spacing of about 1 mm between adjacent pins. In alternate embodiments any suitable number of pins could be provided in any suitable spacing and in any suitable pattern. The header 70 is adapted to be fixedly mounted to a printed circuit board (see FIG. 7). The use of a header 70 can help to standardize connection of the printed circuit board to the electrical connectors 22 such that misconnection will not occur. The use of the header 70 also helps to reduce manufacturing time by eliminating time-consuming single pin press-fit insertion of pins into the printed circuit boards.

Figure 6:
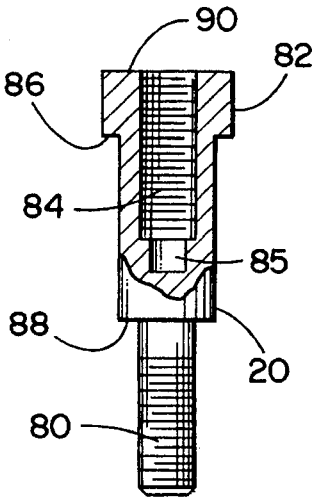
FIG. 6 is a partial cross sectional view of a positioner used in the assembly shown in FIG. 1.

Referring to FIG. 6, there is shown a side view of a positioner 20 with a partial cross-sectional section. The positioner 20 has a bottom threaded section 80 and a top section 82 with a threaded aperture 84. The positioner 20 also has two ledges 86, 88 and a top surface 90. The bottom section 80 is suitably sized and shaped to be received in a threaded aperture of a second positioner. The threaded aperture 84 is suitably sized and shaped to receive a bottom section of a third positioner. The first ledge 86 is adapted to engage a top surface of one of the connectors 22 to firmly seat the connector 22 against a printed circuit board. The second ledge 88 is adapted to engage a top surface of a printed circuit board to firmly seat the board against the top surface 90 of a second positioner connected to the bottom section 80. The positioners 20 are provided to fixedly, but reconfigurably, assembly the assembly 12, such as by adding or removing printed circuit boards. In the embodiment shown, the bottom 85 of the threaded aperture 84 has a hex shape for receiving a hex shaped tool (not shown) that can be used to screw the positioner 20 into another positioner. In an alternate embodiment, the top surface 90 could have a screw driver slot to allow a screw driver to be used to screw in the positioner 20. The positioners 20 allow the boards to be stably stacked and, allow additional levels of boards to be added. The assembly 12 also has covers 92 that are adapted to cover the male contact pins on the top boards 10C, 10E. The covers 92 can be removed if a user desires to add an additional printed circuit board on top of the top boards 10C or 10E. In one type of embodiment, the covers 92 could include a dummy load that is connected to the signal contacts and/or driver circuits.

Figure 7:
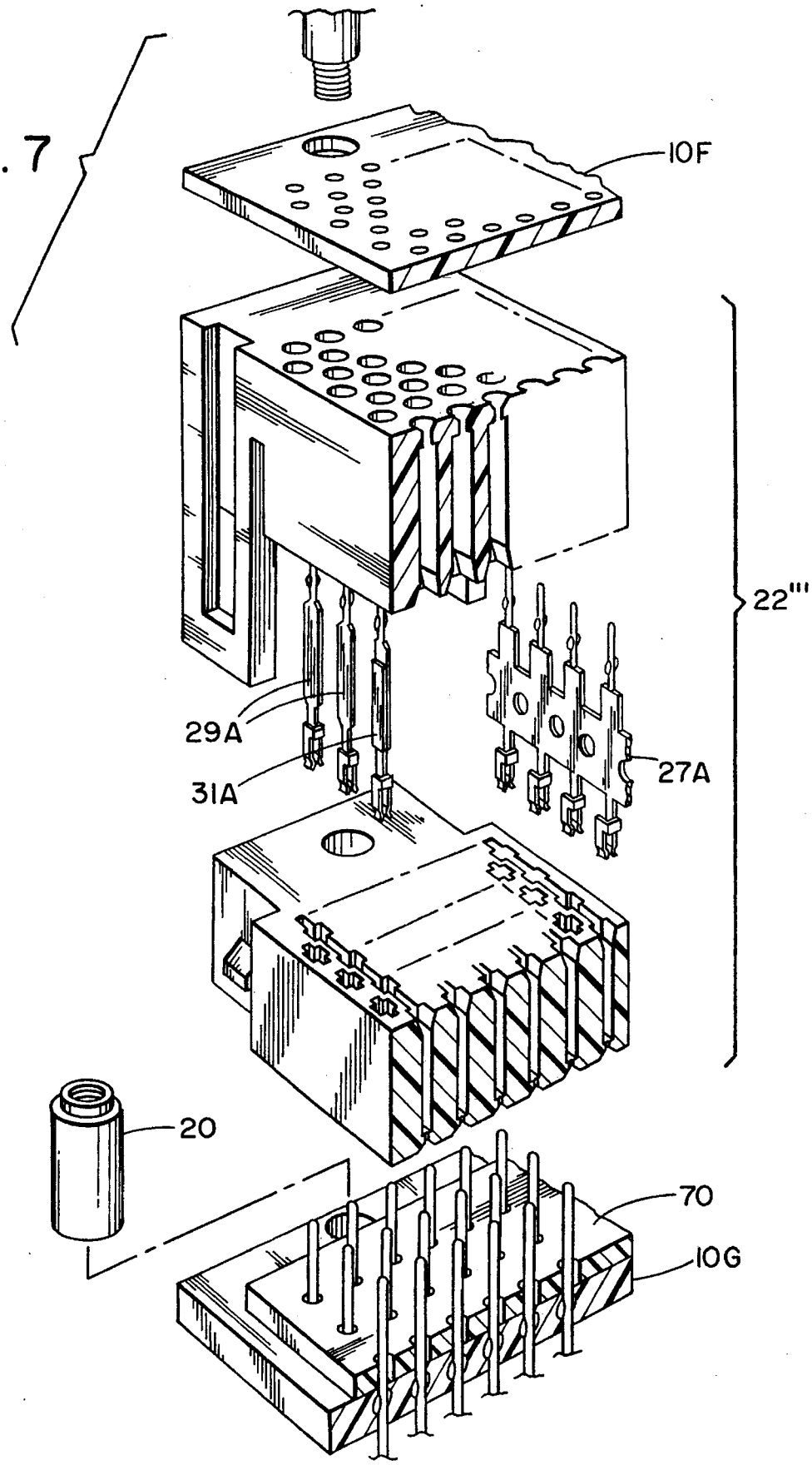
FIG. 7 is an exploded cut-away view of an end of an alternate embodiment of an electrical connector.

Referring to FIG. 7, there is shown a exploded sectional view of an alternate embodiment of the invention. In the embodiment shown, the electrical connector 22''' has power contacts 29A, signal contacts 31A, and ground contact strips 27A with both male and female contact sections. In other alternate embodiments any suitable contact sections could be provided. The male contact sections extend past the top of the connector housing and directly into the printed circuit board 10F. Of course, with this type of electrical connector 22''', the board 10F and connector 22''' could be sold as an preconnected assembly. FIG. 7 also shows how a pin header 70 would be connected to another printed circuit board 10G. Preferably the pin header 70 and board 10G would also be sold to consumers as a preconnected assembly.

Although the present invention has been described with use in connecting printed circuit boards, the present invention could be used in connecting various different types of electronic components to each other. Therefore, as used herein, the term printed circuit board should be understood to include other types of electronic components and cables to such components. In addition, any suitable driver circuit could be provided in the electrical connectors including merely buffers without transceivers.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A system for connecting printed circuit boards to each other, the system comprising:

a first electrical connector connecting two of the printed circuit boards to each other, the electrical connector having a housing with a driver circuit therein, the driver circuit including a transceiver for synchronous two way communication between the two boards;

positioners located, at least partially, between the two printed circuit boards, the positioners fixedly positioning the two boards relative to each other in spaced parallel configuration; and means for delaying transmission of signals through the transceiver.

2. A system as in claim 1 further comprising a second electrical connector connecting a third printed circuit board to the two printed circuit boards, the second electrical connector being aligned with the first electrical connector such that the first and second electrical connectors sandwich a portion of one of the two printed circuit boards therebetween.

3. A system as in claim 1 wherein the circuit driver of the first electrical connector includes a buffer to repeat and strengthen a digital signal.

4. A system as in claim 1 wherein the first electrical connector includes power contacts and ground contacts.

5. A system as in claim 1 wherein the first electrical connector includes signal contacts.

6. A system as in claim 5 wherein at least some of the signal contacts are filtered contacts.

7. A printed circuit board assembly comprising:

a plurality of spaced parallel printed circuit boards;

a plurality of electrical connectors connecting at least some of the printed circuit boards to each other in series, the electrical connectors being sandwiched between adjacent boards and aligned in at least one row, at least one of the electrical connectors having a driver circuit with a buffer adapted to repeat and strengthen digital signals transmitted therethrough;

positioners fixed to the printed circuit boards to hold the boards in their spaced parallel configuration; and means for controlling timing of transmission of signals through the electrical connector to provide synchronous communication between the boards.

8. An assembly as in claim 7 wherein at least one of the printed circuit boards has a pin header connected thereto that connects the at least one printed circuit board to at least one of the electrical connectors.

9. An assembly as in claim 8 wherein the pin header connects the at least one printed circuit board to two of the electrical connectors, one on each side of the at least one printed circuit board.

10. An assembly as in claim 7 wherein the electrical connectors include power contacts and ground contacts.

11. An assembly as in claim 10 wherein at least one of the electrical connectors includes filtered signal contacts.

12. An electrical connection system for connecting first and second printed circuit boards to each other, the system comprising:

a contact header fixedly connected to the first printed circuit board, the header comprising a frame and a plurality of first electrical contacts having first and second male contact areas extending from opposite sides of the first board;

an electrical connector comprising a housing and a plurality of second electrical contacts, the second electrical contacts including power contacts and ground contacts with first ends having female contact areas removably connected to the first male contact areas of the first electrical contacts and second ends electrically connected to the second printed circuit board adjacent a first side of the second board; and a cover removably connected to the first printed circuit board and to the electrical connector, the cover covering the second male contact areas extending from the first printed circuit board.

13. A system as in claim 12 wherein the electrical connector includes a driver circuit therein.

14. A printed circuit board assembly comprising:

a plurality of printed circuit boards;

electrical connectors connecting at least three of the printed circuit boards to each other in series; and means for transmitting signals among the at least three printed circuit boards wherein signals sent from one of the three boards at an end of the series can be delivered at two other of the at least three boards at the same time.

15. An assembly as in claim 14 wherein the means for transmitting includes transceivers located in the electrical connectors.

16. An assembly as in claim 14 wherein the electrical connectors include buffers for repeating and strengthening signals transmitted therethrough.

17. An assembly as in claim 14 wherein the means for transmitting has means for time delaying transmission of signals to predetermined boards of the at least three printed circuit boards.

18. In a printed circuit board assembly with printed circuit boards connected by an electrical connector, the connector having a housing and a driver circuit, the improvement comprising:

means for controlling the driver circuit for synchronously delaying transmission of signals through the driver circuit.

19. An assembly as in claim 18 wherein the driver circuit further comprises a buffer.

20. An assembly as in claim 18 further comprising means for transmitting signals through the connector without an added time delay by the driver circuit.

21. In a printed circuit board assembly with printed circuit boards connected by an electrical connector, the connector having a housing and a driver circuit, the improvement comprising:

means for controlling clock skew between the boards comprising controlling the driver circuit to delay transmission of at least some signals between the boards.

* * * * *